US005924691A

United States Patent [19]

Meng-Suen

[11] Patent Number: 5,924,691

[45] Date of Patent: Jul. 20, 1999

[54] LIQUID-FILLED DISPLAY OR AMUSEMENT DEVICE HAVING DIVING OBJECT THEREIN

[75] Inventor: Huang Meng-Suen, Kowloon, China

[73] Assignee: Mr. Christmas, Inc., New York, N.Y.

[21] Appl. No.: 08/947,322

[22] Filed: Oct. 8, 1997

[51] Int. Cl.[6] ..... A63H 23/08

[52] U.S. Cl. ..... 273/138.5; 273/457; 273/458

[58] Field of Search ..... 273/457, 458, 273/138.5

[56] References Cited

U.S. PATENT DOCUMENTS

| | | | |
|---|---|---|---|
| 1,991,626 | 2/1935 | Rawdon | 273/457 |
| 2,779,131 | 1/1957 | Scheithauer | 273/457 |
| 3,077,697 | 2/1963 | Fry | 273/457 |
| 3,535,805 | 10/1970 | Peiperl | 40/106.21 |
| 3,846,934 | 11/1974 | Thorn et al. | 46/232 |
| 3,924,350 | 12/1975 | Hsu | 273/457 |
| 4,032,141 | 6/1977 | Tanimura | 273/457 |
| 4,142,715 | 3/1979 | Matsumoto | 273/457 |
| 4,223,471 | 9/1980 | Greenberg | 273/457 |
| 4,362,299 | 12/1982 | Suzuki | 273/457 |
| 4,363,483 | 12/1982 | Minami | 273/457 |
| 4,778,429 | 10/1988 | Todokoro | 446/153 |
| 4,817,311 | 4/1989 | Ong S. T. | 40/410 |
| 4,923,429 | 5/1990 | Lewis | 446/197 |
| 5,017,171 | 5/1991 | Shiina | 446/197 |
| 5,098,111 | 3/1992 | Kashimoto | 273/457 |
| 5,213,540 | 5/1993 | Yang | 446/180 |
| 5,279,512 | 1/1994 | Manale | 446/217 |
| 5,286,535 | 2/1994 | Hou | 428/11 |
| 5,421,764 | 6/1995 | Namiki | 446/197 |

FOREIGN PATENT DOCUMENTS

| | | | |
|---|---|---|---|
| 1076803 | 5/1980 | Canada . | |
| 2913469 | 10/1980 | Germany | 273/457 |
| 1421355 | 9/1988 | U.S.S.R. . | |

*Primary Examiner*—Benjamin H. Layno
*Attorney, Agent, or Firm*—Fitzpatrick, Cella, Harper & Scinto

[57] ABSTRACT

A display device comprising a main enclosure having liquid disposed therein, a pressure change actuator coupled in fluid communication with the main enclosure for performing at least one of compressing and decompressing of the contents of the main enclosure, thereby respectively increasing and decreasing the internal pressure within the main enclosure, and a diving member disposed in the liquid of the enclosure and having at least one liquid-filled cavity therein in fluid communication with the liquid of the main enclosure, the diving member comprising at least one air-filled flexible member disposed in the liquid-filled cavity.

17 Claims, 6 Drawing Sheets

LIQUID-FILLED DISPLAY OR AMUSEMENT DEVICE HAVING DIVING OBJECT THEREIN

BACKGROUND OF THE INVENTION

1. Field of the Invention

The present invention relates to a liquid-filled display or amusement device, and more particularly relates to a liquid-filled display or amusement device having a liquid-filled container with a diving object disposed therein which rises and falls in response to pressure changes within the container.

2. Description of the Related Art

There is something fascinating about watching objects moving about inside a liquid-filled container, and perhaps the most common example of a liquid-filled display device is the water globe. The water globe typically consists of a small, sealed, transparent, water-filled container, which is hemispherical, spherical, or the like, and which has small objects disposed therein representing snowflakes, stars, etc. Typically, the objects are heavier than water and settle to the bottom of the container. Because the water globe has no means for moving the objects, it is necessary to shake or tilt the water globe to cause the objects therein to move.

Another way to cause objects in a liquid-filled container to move is to drive the objects using jets of water, waves, bubbles, or circulation or stirring of the water. Various such methods have been adopted in a variety of water-filled games or amusement devices. See, e.g., U.S. Pat. No. 3,535,805, to Peiperl, No. 4,032,141, to Tanimura, No. 4,142,715, to Matsumoto, No. 4,817,311, to Ong S. T., No. 4,923,429, to Lewis, and No. 5,213,540, to Yang.

However, none of the foregoing methods are amenable to creating a liquid-filled display or amusement device having a diving object therein. A diving object can be controlled so as to rise and fall in the liquid. A number of attempts to create such an object have been made. The deep sea diving game of U.S. Pat. No. 1,991,626, to Rawdon, features a diving figure, with a head section having a ball which contains an air bladder and which has perforations. A tube connects the air bladder with a bellows, and when the bladder is deflated (through the tube), water enters the ball through the perforations, causing the figure to become heavier than water and to descend. In another approach, Soviet Patent No. 1421355 (Mikrdprovod) shows a transparent vessel filled with water, and a hollow ball floating in the water. When a flexible element connected to the vessel is pressed, the increase of pressure in the vessel causes the ball to sink.

However, these conventional diving object devices suffer from a number of problems or possible drawbacks. The device in the Rawdon patent requires that the diving object be connected to an air tube. Thus, the diving object cannot be freestanding or self-contained. In the Soviet patent, when the flexible element is pressed and the pressure in the vessel is increased, the increased pressure could compress the hollow ball and cause its exterior to be deformed unattractively. Furthermore, changes in ambient conditions may affect its operation, because of the so-called "shrink and expand" phenomenon. In the shrink and expand phenomenon, changes in ambient conditions (i.e., the conditions in the room in which a sealed, liquid-filled container is placed) may affect the internal pressure within the container. For example, if the ambient temperature (i.e., the temperature in the room in which the container is placed) were to increase, so also would the temperature of the liquid within the container. This in turn would cause the liquid to expand, thereby increasing the internal pressure within the container. In like fashion, a dropping temperature would cause the liquid to shrink, thereby decreasing the internal pressure within the container.

When the internal pressure changes as a result of the shrink and expand phenomenon, two possible problems may arise. First, the change in internal pressure may cause the hollow ball to rise or fall in the liquid, independently of operation of the flexible element. Secondly, the change in internal pressure may cause the flexible element to change its free length, which is the length which the flexible element attains when the system is in equilibrium. This change in free length might make it difficult to couple a driving member to the flexible element so as to compress and/or decompress the flexible element, if such were desired.

Accordingly, an improved display or amusement device is needed to address the above-noted problems and possible drawbacks of conventional devices.

SUMMARY OF THE INVENTION

It is a principle object of the present invention to provide an improved liquid-filled display or amusement device.

Accordingly, a first object of the present invention is to provide an improved diving object which is freestanding or self-contained or freely-floating or not connected by a tube such as an air-tube or the like, and which has a rigid exterior surface (so that its outer surface is not deformed by pressure changes), and a display or amusement device having such a diving object.

Another object of the present invention is to provide an improved display or amusement device which has a self-pressure stabilizer for counterbalancing the shrink and expand phenomenon. This can be accomplished by stabilizing or adjusting the internal pressure within the liquid-filled container or enclosure of the liquid-filled display device so as to compensate for the change in internal pressure caused by variations in ambient conditions such as temperature. Preferably, the self-pressure stabilizer should be automatic.

Yet another object of the present invention is to provide an improved display or amusement device which has a coupling mechanism for positively coupling a pressure actuator (such as a flexible bellows-like member) for pressurizing and/or decompressing the contents of the liquid-filled container, with a driving mechanism for driving the pressure actuator, despite change in the free length of the pressure actuator caused by variations in ambient conditions.

In view of the foregoing objects, in one aspect, the present invention relates to a display device comprising a main enclosure having liquid disposed therein, a pressure change actuator coupled in fluid communication with the main enclosure for performing at least one of compressing and decompressing of the contents of the main enclosure, thereby respectively increasing and decreasing the internal pressure within the main enclosure, and a diving member disposed in the liquid of the enclosure and having at least one liquid-filled cavity therein in fluid communication with the liquid of the main enclosure, the diving member comprising at least one air-filled flexible member disposed in the liquid-filled cavity.

In another aspect, the present invention relates to a display apparatus comprising a container having liquid disposed therein, a pressure change actuator for changing the pressure within the container, and an automatic self-pressure stabilizer in fluid communication with the contents of the container which automatically adjusts the pressure within the container in response to shrinkage or expansion of the liquid within the container.

In still another aspect, the present invention relates to an apparatus comprising a liquid-filled enclosure, a flexible bellows member in fluid communication with the contents of the liquid-filled enclosure for performing at least one of compressing and decompressing of the contents of the liquid-filled enclosure, a driving member for driving the flexible bellows member to effect at least one of compressing and decompressing of the contents of the liquid-filled enclosure, and coupling means disposed between the flexible bellows member and the driving member for coupling the bellows member and the driving member to maintain physical linkage between the bellows member and the driving member despite change in a free length of the bellows member.

In still another aspect, the present invention relates to an apparatus comprising an enclosure having liquid disposed therein, pressure change actuator arranged in fluid communication with the contents of the enclosure for performing at least one of increasing and decreasing of the internal pressure of the enclosure, and a pressure stabilizer separate from the pressure change actuator for performing at least one of increasing and decreasing of the internal pressure within the enclosure to counterbalance a change in pressure.

In a still further aspect, the present invention relates to a display device comprising a sealed enclosure having liquid disposed therein, pressure change means connected to the enclosure for performing at least one of increasing and decreasing the internal pressure within the enclosure, driving means for driving the pressure change means, a manual pressure stabilizer connected to the enclosure and being separate from the pressure change means, for performing at least one of increasing and decreasing the internal pressure within the enclosure in response to a manual operation.

In yet another aspect, the present invention relates to a freely-floating diving object for performing at least one of a rising motion and a diving motion in liquid in which the diving object is placed, the diving object comprising a rigid exterior member having at least one internal cavity and at least one opening therethrough to allow liquid about the diving object to pass to and from the internal cavity, and at least one airtight flexible air-filled member disposed within the internal cavity; the airtight flexible air-filled member being compressed and decompressed by respective increase and decrease of the pressure of the liquid so as to cause the diving object to perform a diving motion and a rising motion, respectively, in the liquid in which the diving object is placed.

These and other objects, aspects, advantages and features of the present invention will become more apparent from the following detailed description of the preferred embodiments taken in conjunction with the accompanying drawings.

DESCRIPTION OF THE PREFERRED EMBODIMENTS

Generally speaking, the preferred diving objects of the present invention operate in accordance with the principle of water conversion (also known as the floating principle or the buoyancy principle) which explains the forces operating upon a floating object. The principle states that the upward buoyant force exerted upon an object by the liquid in which it floats is defined by the formula $Bf=V\times S$, where V is the volume of liquid displaced by the object, and S is the specific gravity of the liquid. The greater the volume V is, the greater the buoyant force Bf; the less the volume V is, the smaller the buoyant force Bf. By increasing V, the buoyant force Bf increases, and thereby the object is urged to move upwards in the liquid-filled container in which it is disposed. Likewise, by decreasing V, the buoyant force Bf decreases, and thereby the object is urged to move downwards (i.e., fall or dive) in the liquid-filled container. The preferred diving objects according to the present invention therefore are characterized in that their volume is variable. More precisely, they are capable of changing their shape so as to displace a variable volume V of water, thereby changing the buoyant force Bf and causing the diving objects to rise or fall.

Figure 1:
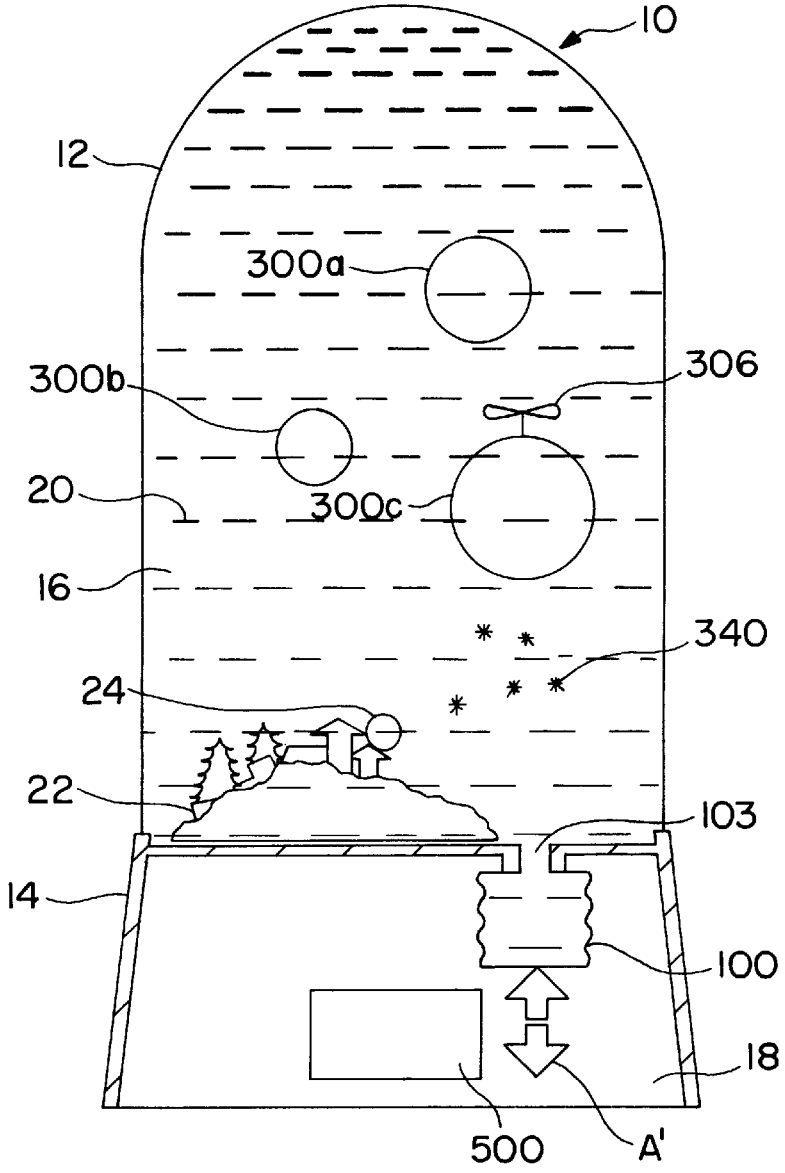
FIG. 1 is a side elevational view partly in cross-section of a liquid-filled display device according to a first embodiment of the present invention.

In FIG. 1 there is depicted a liquid-filled display or amusement device 10 according to a first embodiment of the present invention. The liquid-filled display device 10 includes a sealed liquid-filled main enclosure 16, a pressure change actuator (embodied by an actuating bellows 100) for compressing and/or decompressing the contents of the main enclosure 16, and at least one diving object (three are shown in FIG. 1, designated by reference numerals 300*a*, 300*b*, and 300*c*).

In the preferred embodiment shown in FIG. 1, the main enclosure 16 (also referred to as the cavity or container) is defined by the space between a cover 12 and a base 14 of the liquid-filled display device 10. The cover 12 preferably is constructed from a rigid material such as glass or polymer, and it may be translucent, or more preferably, transparent, so that the diving objects may be viewed easily. In the preferred embodiment shown in FIG. 1, the cover 12 is a hollow cylinder having a hemispherical top, but it is not limited to this design.

As for the base 14, preferably it is constructed from a hard and rigid material such as polymer, metal, glass, ceramic, wood, clay, or any combination thereof. It is preferred that the base 14 be hollow, with a cavity 18 into which the actuating bellows 100, and a driving mechanism 500 therefor (shown in block outline form in FIG. 1), are positioned. To prevent leaking of the liquid from the main enclosure 16, a leak-proof seal (not shown in FIG. 1) preferably is disposed between the cover 12 and the base 14.

The main enclosure 16 of the present invention need not be limited to a separate cover and base configuration; instead, any enclosure for holding liquid, of either one-piece or other construction, may be employed to achieve a desired visual effect.

Liquid 20 completely or partially fills the main enclosure 16. Preferably, the liquid 20 is water or a water-based liquid, or oil or an oil-based mixture, or mixtures thereof. It may be clear, transparent, colored, uncolored, or translucent, without limitation.

Figure 4:
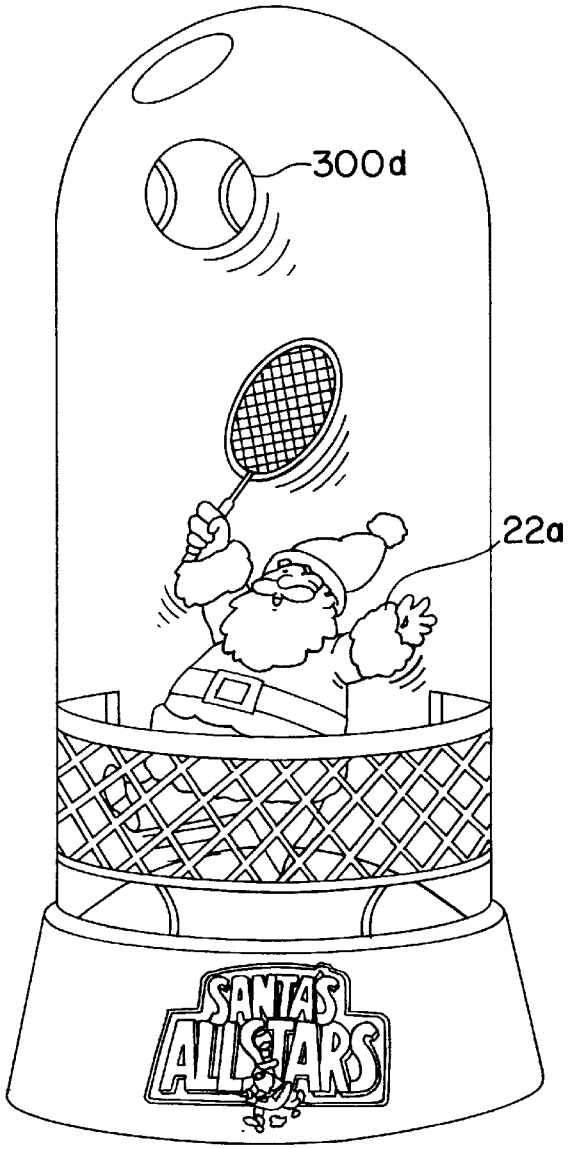
FIG. 4 is a side elevational view of one example of a liquid-filled display device according to the present invention.
Figure 5:
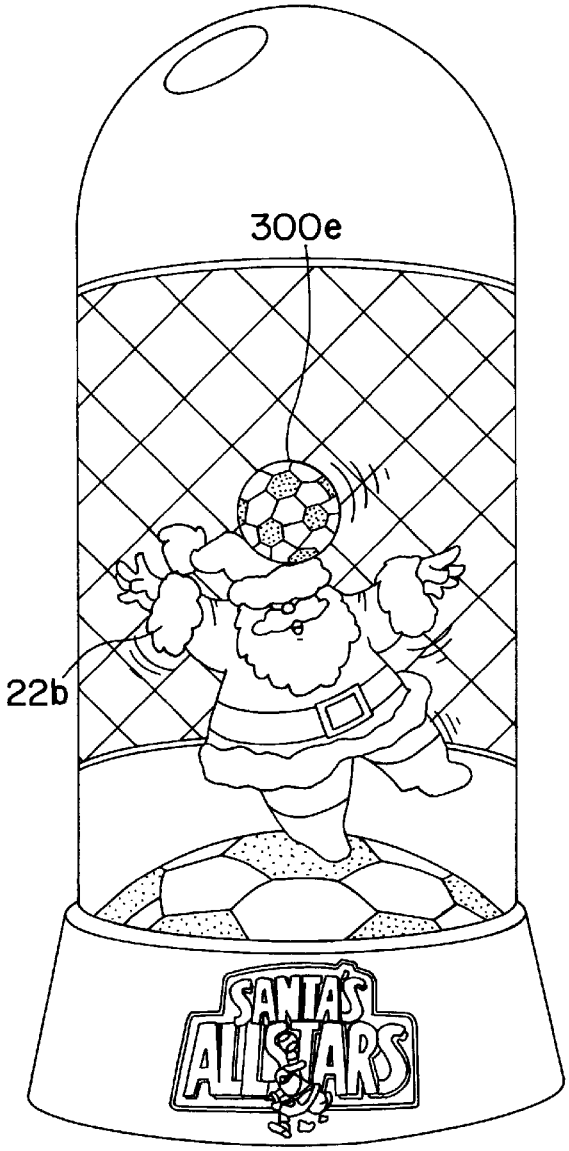
FIG. 5 is a side elevational view of another example of a liquid-filled display device according to the present invention.

Preferably, one or more stationary objects depicting a scene are disposed within the enclosure 16. FIG. 1 shows a stationary object 22, which is configured in the shape of a landscape including a mountain, two trees, and several houses. The stationary object 22 has a light 24 which illuminates the liquid 20. FIG. 4 shows an alternate embodiment according to the present invention, including a stationary object 22*b* comprising a Santa Claus figurine standing on a surface resembling a tennis ball and having a tennis racquet. FIG. 5 shows another alternate embodiment according to the present invention, including a stationary object 22*c* comprising a Santa Claus figurine standing on a surface patterned like a soccer ball. The appearance and specific arrangement of the stationary objects, lights, and the like may be varied to produce a desired visual effect; alternatively, they may be omitted altogether, as they are optional and need not be included.

Also disposed in the liquid 20 of the main enclosure are one or more diving objects, which are configured to rise and fall in the liquid in accordance with the water conversion principle discussed above. In the preferred embodiment described with respect to FIG. 1, there are three such diving objects, designated by reference numerals 300*a,* 300*b,* and 300*c*.

Figure 2:
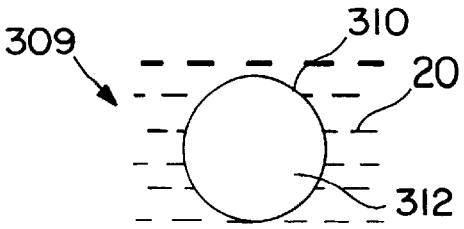
FIG. 2 is a side elevational view of an air-filled diving object according to the present invention.
Figure 3:
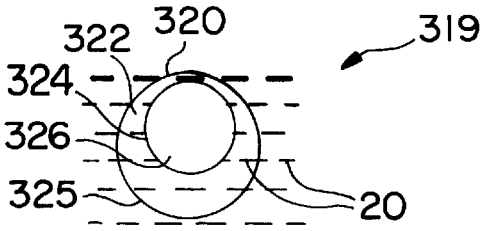
FIG. 3 is a side elevational view of a diving object having an air-filled balloon therein according to the present invention.

The construction of the diving objects is schematically depicted in FIGS. 2 and 3, which respectively show alternative preferred structures, with the FIG. 3 structure being most preferred. Turning first to FIG. 2, there is shown a diving object generally indicated by reference numeral 309, disposed in the liquid 20 of the main enclosure 16. The diving object 309 comprises an air-filled flexible member 310, the air-filled cavity of which is designated by reference numeral 312. Preferably, the flexible member 310 is an air-filled bladder or balloon or bellows or bellows-like member or the like. In FIG. 2, the diving object 309 is configured in the shape of a spherical ball; however, it is not limited to such a shape.

When the internal pressure within the main enclosure 16 is increased, the flexible member 310 is compressed and shrinks. When this happens, the diving object 309 displaces less liquid, and it dives (i.e., falls) in accordance with the water conversion principle discussed above. When the internal pressure in the main enclosure 16 is decreased, the flexible member 310 is decompressed and expands. The diving object 309 thus displaces more liquid, and it rises in accordance with the water conversion principle.

A more preferred diving object 319 is shown in FIG. 3. The diving object 310 shown in FIG. 3 comprises a rigid member 320 having a liquid-filled cavity 322 therein. The liquid-filled cavity 322 communicates through one or more holes or openings 325 in the rigid member 320 with the liquid 20 of the main enclosure 16. In other words, the rigid member 320 is configured so that the liquid 20 in the main enclosure 16 may flow freely to and from the liquid-filled cavity 322. Floating within the liquid-filled cavity 322 is an air-filled flexible member 324, the air-filled cavity of which is designated by reference numeral 326. Preferably, the flexible member 324 is a bladder or a balloon or bellows or a bellows-shaped member or the like, and although shown in FIG. 3 as being spherical in shape, it is not limited to such a shape.

When the internal pressure within the main enclosure 16 increases, the pressure change is communicated via the liquid 20 through the liquid-filled cavity 322 to compress the flexible member 324 so as to displace less liquid. Accordingly, the buoyant force supporting the diving object 319 is decreased, and the diving object dives in accordance with the water conversion principle. On the other hand, if the pressure within the main enclosure 16 decreases, the reverse process takes place, and the diving object 319 rises.

Between the diving objects 309 and 319 of FIGS. 2 and 3, respectively, the latter is the preferred construction. This is because the rigid exterior member 320 of the diving object 319 will not be deformed by changes of internal pressure within the main enclosure 16. Therefore, from the perspective of a viewer, the diving object 319 rises and falls without changing shape. The diving object 319 of FIG. 3 is shown as having a single liquid-filled cavity 322 and a single air-filled flexible member 324; however, it is not limited to such, and may include plural numbers of one or both.

Although the preferred flexible members 310 and 324 of the diving objects have been described above as being air-filled, their construction is not limited to such; alternatively, they may be of solid construction, being composed of a flexible material which can be compressed and decompressed by changes of internal pressure within the main enclosure 16, so as to displace less or more liquid, thereby respectively falling or rising in accordance with the water conversion principle.

Furthermore, the appearance and specific arrangement of the diving objects according to the present invention may be varied to produce a desired visual effect. For example, in the alternate embodiments respectively shown in FIGS. 4 and 5, the diving objects 300*d* and 300*e* (which preferably are constructed as shown in FIG. 2 or FIG. 3) are patterned to resemble a tennis ball and a soccer ball, respectively. Furthermore, optionally, one or more moving parts may be added to the diving objects according to the present invention. In FIG. 1, the diving object 300*c* has a propeller 306 rotatably mounted on its exterior surface. As the diving object 300*c* rises and falls in the liquid, the propeller 306 is driven by fluid dynamics of the liquid 20 to rotate. Of course, the propeller shape is exemplary, and the moving parts are not limited to such a construction; rather, they may be of any shape configured to move, spin, rock, wave, or the like, as the diving object moves through the liquid.

In addition to the diving objects 300*a,* 300*b,* and 300*c,* the preferred embodiment shown in FIG. 1 includes optional free motion objects 340, which preferably are tiny objects similar to the snowflakes of a water globe. These may be of any shape and may be varied to produce a desired visual effect. When the actuating bellows 100 is compressed, the resulting movement of water causes the free motion objects 340 to move about in the liquid.

As has been described above, the diving objects 300*a*, 300*b*, and 300 are driven via the water conversion principle to rise and dive in response to change in the internal pressure within the main enclosure 16. In the preferred embodiment shown in FIG. 1, this pressure change is effected by a pressure change actuator embodied as the flexible actuating bellows 100. The actuating bellows has an opening at one end, and through that opening and through a hole 103 in the base 14, it is in fluid communication with the main enclosure 16 and its contents. Preferably, the actuating bellows 100 is flexible and leak-proof, and is composed of polymer, rubber, or the like.

When the actuating bellows 100 is compressed, its volume decreases, as does the effective volume of the main enclosure 16 with which the actuating bellows 100 is in fluid communication, thereby compressing the contents of the main enclosure 16 and as a result increasing the internal pressure within the main enclosure 16. This causes the diving objects to dive via the water conversion principle, as discussed above. On the other hand, when the actuating bellows 100 is allowed to decompress, or is pulled to extend further from the liquid-filled display device, its volume increases, as does the effective volume of the main enclosure 16, thereby decompressing the contents of the main enclosure 16 and as a result decreasing the internal pressure within the main enclosure 16. This causes the diving objects to rise via the water conversion principle, as discussed above. Although the pressure change actuator is preferably embodied as a flexible actuating bellows 100, it is not limited to such a construction, and may alternatively be embodied as any mechanism capable of increasing or decreasing the pressure within the main enclosure 16.

The actuating bellows 100 is driven in the embodiment of FIG. 1 by a driving mechanism 500. The driving mechanism 500 performs at least one of compressing (i.e., pushing) and decompressing (i.e., pulling) the actuating bellows 100, as shown by the arrow A' in FIG. 1. The driving mechanism 500 is shown in block outline form in FIG. 1, and preferably comprises an electric motor, a wind-up spring, or the like.

Figure 6:
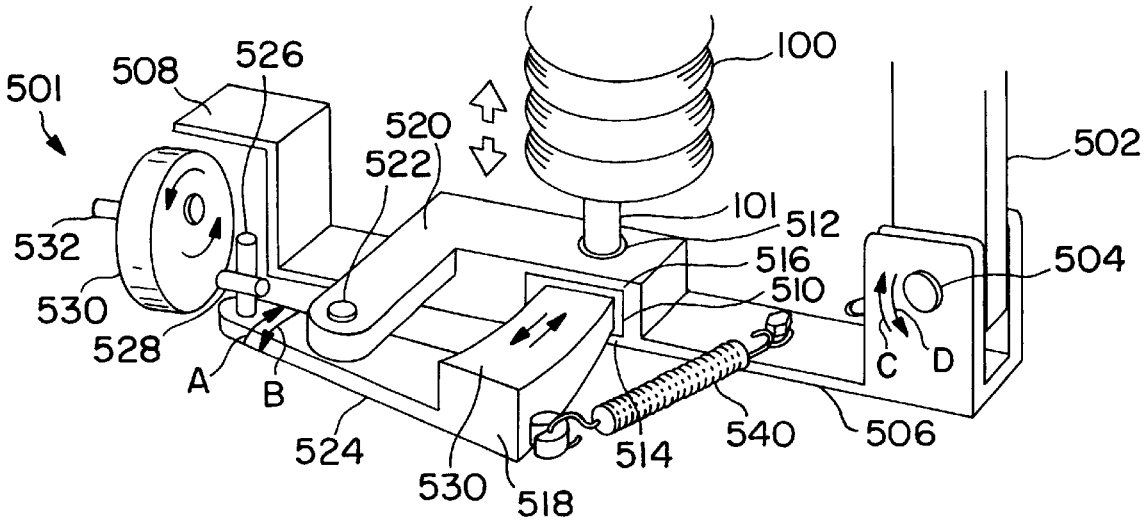
FIG. 6 is a partial perspective view showing a self-adjuster driving mechanism according to the present invention.
Figure 7:
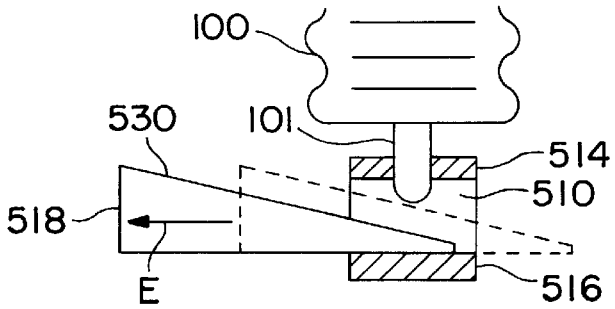
FIG. 7 is a cross-sectional view of the self-adjuster driving mechanism of FIG. 6.
Figure 8:
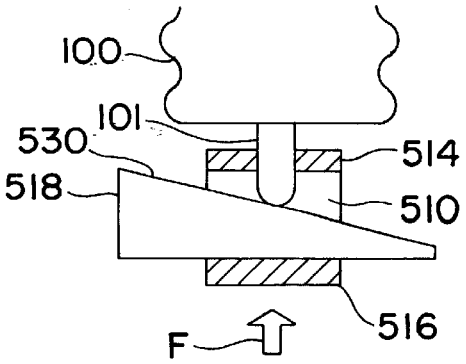
FIG. 8 is another cross-sectional view of the self-adjuster driving mechanism of FIGS. 6 and 7.

A preferred construction of the driving mechanism 500, namely a self-adjuster driving mechanism 501, is shown in FIGS. 6 through 8. The self-adjuster driving mechanism 501 generally comprises an actuator lever 506 for driving the actuating bellows 100, a driving cam 530 for driving the actuator lever 506, and an adjuster lever 524 for positively coupling the actuator lever 506 to a bellows ram 101 which extends from the bottom of the actuating bellows 100, so that when the actuator lever 506 is driven, it compresses the actuating bellows 100. The actuating lever 506 is rotatably attached by a pin 504 to a bar 502 which is fixedly attached to the base 14 of the liquid-filled display device 10.

Rotatably attached to a projection 520 of the actuating lever 506, by a pin 522, is an adjuster lever 524. At one end of the adjuster lever 524 is disposed a pin 526, and at the other end is disposed a wedged anvil 518. Preferably, the wedged anvil 518 is a triangular wedge having a top sloped surface 530. A rectangular opening 510 extends through the actuating lever 506, and is defined by top and bottom walls 514 and 516. As the adjuster lever 524 rotates, the wedged anvil moves into and out of the rectangular opening 510 in the actuating lever 506.

In the top wall 514 of the actuating lever 506 is a cylindrical hole 512, through which the bellows ram 101 of the actuating bellows 100 movably extends into the opening 510. Attached to and extending between the wedged anvil 518 and the actuator lever 506 is a tension spring 540 which, when stretched, biases the adjuster lever 524 so as to rotate its wedged anvil 518 into the opening 510. An electric motor (not shown) drives the driving axle 532 of an eccentrically-mounted driving cam 530. On the side of the driving cam 530 is a cam pin 528.

In operation, the electric motor drives the driving cam 530 by powering its axle 532. As the driving cam 530 rotates in a counterclockwise direction, the cam pin 528 which extends from the face of the driving cam 530 comes to impinge upon the pin 526 of the adjuster lever 524, thereby urging the adjuster lever 524 to rotate clockwise around the pin 522 as indicated by arrow A. As a result, the wedged anvil 518 of the adjuster lever 524 rotates out of the opening 510 as shown in FIG. 7, moving from the dotted-line position to the solid-line position in the direction shown by arrow E. Also the tension spring 540 is charged so as to bias the adjuster lever 524, but the adjuster lever 524 is prevented from being driven by the tension spring 540 in the direction B because of the contact between the cam pin 528 and the pin 526 of the adjuster lever 524.

As the driving cam 530 turns further, the cam pin 528 is eventually released from contact with the pin 526 of the adjuster lever 524. The tension spring 540 then drives the adjuster lever 524 to rotate counterclockwise around the pin 522 (in the direction shown by arrow B in FIG. 6). As a result, the wedged anvil 518 is inserted into the opening 510 (in the opposite direction of arrow E of FIG. 7) and is wedged against the bellows ram 101 with its sloped surface 530 contacting the bellows ram 101, as shown in FIG. 8. This ensures contact between each of (a) the bottom wall 516 of the actuator lever 506, (b) the wedged anvil 518, and (c) the bellows ram 101, thereby positively coupling the self-adjuster driving mechanism 501 to the actuating bellows 100.

The self-adjuster driving mechanism 501 thereby addresses the problem of variations in the free length of the actuating bellows 100 caused by the shrink and expand phenomenon. For example, if the free length of the actuating bellows 100 had shrunk because of a decreased temperature within the contents of the main enclosure 16 (due to, for example, a change, e.g., a decrease, in the ambient temperature), then the self-adjuster driving mechanism 501 would adjust the position of the wedged anvil 518 to ensure positive contact and coupling between the actuating bellows 100 and the self-adjuster driving mechanism 501, in the manner described above, despite the change in free length.

As the eccentric driving cam 530 continues to rotate, its outer surface contacts and urges a projection 508 of the actuator lever 506, which in turn rotates around the pin 504 in the direction shown by arrow C in FIG. 6. As best seen in FIG. 6, the projection 508 is shaped to avoid contact by the cam pin 528. As the actuator lever 506 rotates, it urges the bellows ram 101 of the actuating bellows 100 through the coupling defined by the bottom wall 516 and the wedged anvil 518 shown in FIG. 8 in the direction F shown in that figure. This serves to compress the actuating bellows 100, increasing the internal pressure of the contents of the main enclosure 16, and thereby causing the diving objects to dive via the water conversion principle.

As the driving cam 530 continues to turn, its outer surface causes the actuator lever 506 to be lowered and to rotate around the pin 504 in the direction shown by arrow D in FIG. 6, thereby allowing the actuating bellows 100 to decompress and expand in the opposite direction of arrow F in FIG. 8. The resulting decompression of the contents of the main enclosure 16 causes the diving objects to rise within the liquid via the water conversion principle, in the manner described above.

Because the outer surface of the driving cam 530 contacts and drives the actuator lever 506 which in turn drives the actuating bellows 100, the shape of the driving cam 530 dictates the frequency and magnitude of the compression and/or decompression of the actuating bellows 100, and thereby the behavior exhibited by the diving objects. Accordingly, the shape of the driving cam 530 may be varied to control the timing and speed of diving and rising of the diving objects.

In addition to the self-adjuster driving mechanism 501, another feature of the present invention for combatting the effects of the shrink and expand phenomenon is an automatic self-pressure stabilizer. Like the self-adjuster driving mechanism 501, the automatic self-pressure stabilizer is optional, and either or both of these features may be included.

Figure 9:
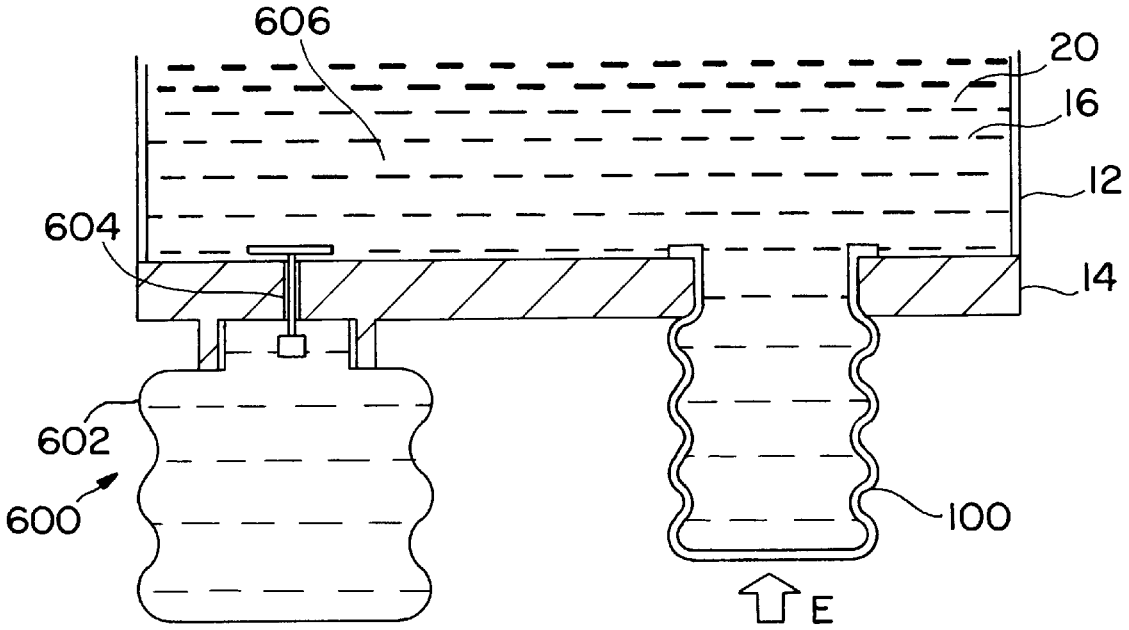
FIG. 9 is cross-sectional view of a self-pressure stabilizer according to the present invention.

The automatic self-pressure stabilizer is shown in FIG. 9, and is generally indicated by reference numeral 600. Included in the automatic self-pressure stabilizer 600 is a flexible compensating bellows 602, a small vent 604, and a free puppet valve 606. Preferably, the flexible compensating bellows 602 is both much larger in volume and is composed of a much more flexible material than the actuating bellows 100. Through the vent 604, which extends through the base 14 to the main enclosure 16, the flexible compensating bellows 602 is in fluid communication with the contents of the main enclosure 16. Within the vent 604 is disposed the free puppet valve 606. The free puppet valve 606 serves to regulate the flow of liquid to and from the main enclosure 16 and the flexible compensating bellow 602.

When the contents of the main enclosure 16 expands due to temperature rise or the like via the shrink and expand phenomenon, the expanded contents seep through the vent 604 and the free puppet valve 606 into the compensating bellows 602, rather than pushing into and expanding the actuating bellows 100. This is thought to occur because the compensating bellows 602 is larger and more flexible than the actuating bellows 100. As a result, the automatic self-pressure stabilizer 600 thereby prevents an increase of the internal pressure within the main enclosure 16.

The main puppet valve 606 is usually open to allow liquid to pass to and from the main enclosure to the flexible compensating bellows 602; however, it is configured to close in response to rapid pressure increases within the main enclosure 16. As a result, when the actuating bellows 100 is pushed rapidly to increase the internal pressure within the main enclosure 16, the free puppet valve 606 closes off the vent 604 to prevent any more of the contents of the main enclosure 16 from passing into the compensating bellows 602. When the actuating bellows 100 is released to return to its free length, the puppet valve 606 opens again, and the automatic self-pressure stabilizer 600 returns to active operation.

On the other hand, if the temperature of the contents of the main enclosure 16 falls, and the contents thus shrink because of the shrink and expand phenomenon, then the automatic self-pressure stabilizer 600 operates in the reverse of what is described above. In other words, because of the pressure differential between the compensating bellows 602 and the main enclosure 16, the contents of the compensating bellows will leak back through the vent 604 into the main enclosure. By this arrangement, the automatic self-pressure stabilizer 600 counterbalances the shrink and expand phenomenon.

Figure 10:
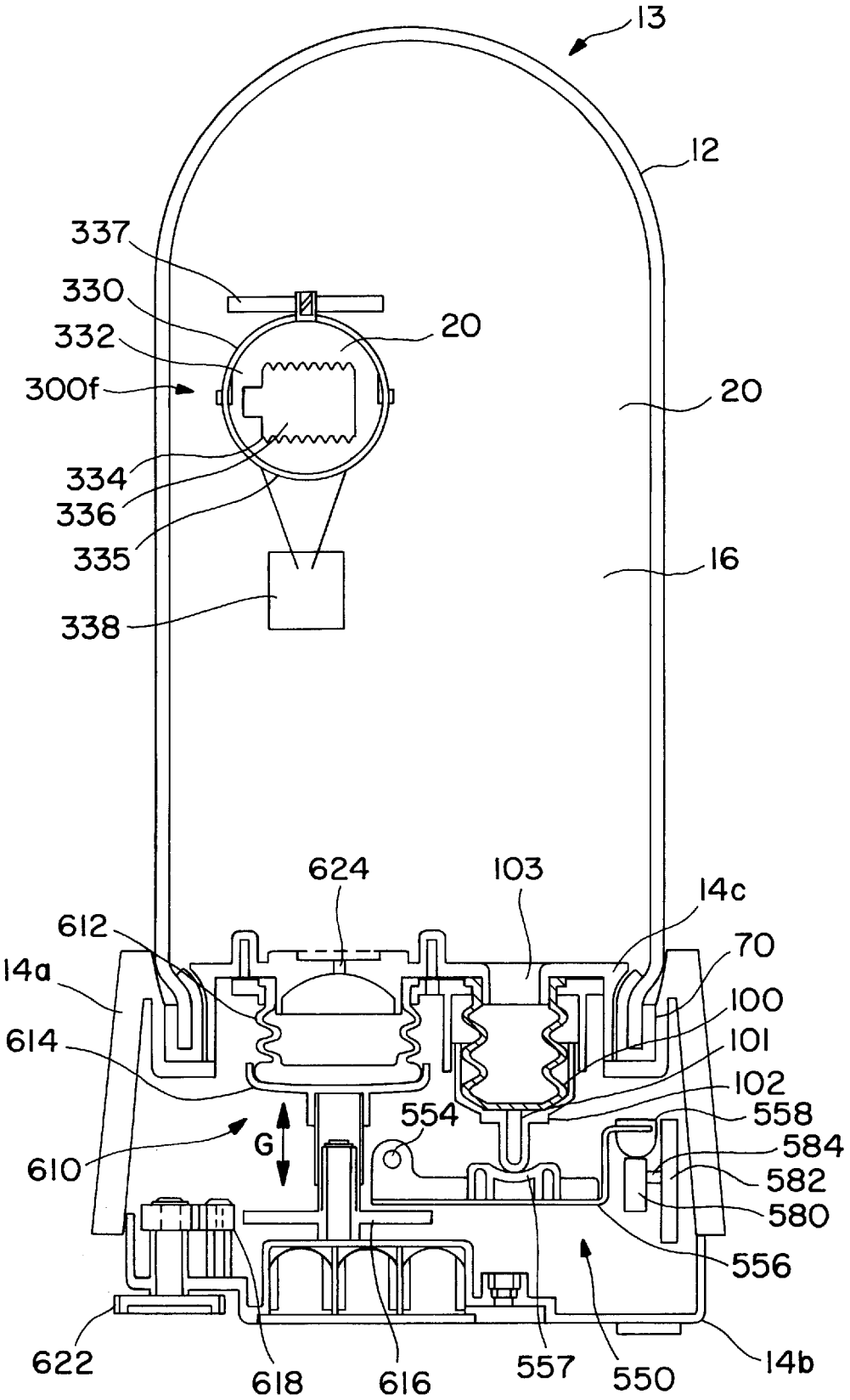
FIG. 10 is a side elevational view partly in cross-section of a liquid display device according to a second embodiment of the present invention.
Figure 11A:
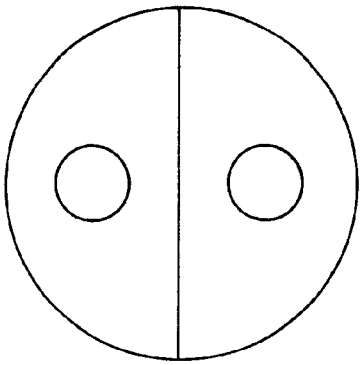
FIGS. 11A and 11B are side elevational views of diving objects according to the present invention, respectively showing a diving object having two liquid-filled cavities with air-filled flexible members therein, and a diving object having a liquid-filled cavity with two air-filled flexible members therein.
Figure 11B:
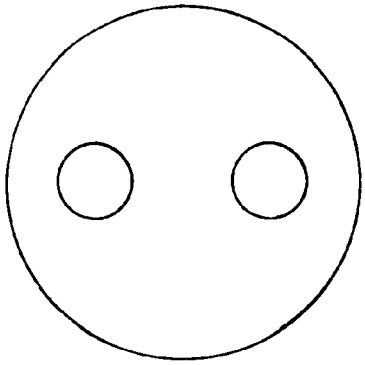

Another preferred embodiment of a liquid-filled display or amusement device according to the present invention is shown in FIG. 10, and is generally indicated by reference numeral 13. The preceding description of those reference numerals in FIG. 10 which are common to other figures is incorporated herein by reference. The remaining discussion will focus on a number of differences between this embodiment and the embodiment of FIG. 1.

Like the embodiment of FIG. 1, the display device shown in FIG. 10 includes a cover 12. However, in lieu of the base 14, there is included a main outer base **14*a* having a bottom cover 14*b*, along with a main chassis 14*c* which serves as the bottom of the main enclosure 16. An orifice 103 in the main chassis 14*c* provides fluid communication between the main enclosure 16 and the actuating bellows 100. A leak-proof seal 70 is disposed circumferentially, about the inside and outside of the bottom edge of the cover 12, and abuts the main chassis 14*c* and the main outer base 14*a*** to provide a leak-proof seal.

The diving object shown in FIG. 10 and generally indicated by reference numeral **300*f* is configured along the lines of that shown in FIG. 3, including an outer rigid member 330 having a liquid-filled cavity 332 with an air-filled bellows 334, the air-filled cavity of which is designated by reference numeral 336. The liquid-filled cavity 332 communicates through one or more orifices or holes 335 with the liquid 20 in the main enclosure 16. A rotatable propeller 337 is mounted as a moving member atop the diving object, and is moves via fluid dynamics as discussed above with respect to the first embodiment of FIG. 1. Attached to the bottom of the diving object 300*f* is a balance weight 338, which serves to keep the diving object 300*f* generally upright in the liquid 20**.

The driving mechanism for the actuating bellows 100 is generally indicated by reference numeral 550, and includes an actuator lever 556 rotatably mounted at a distal end on a pin 554 and having at its proximal end a projection 558. Also included in the driving mechanism 550 is a driving cam 580 having an axle 584 driven by a motor 582. The motor 582 preferably is a DC or AC motor, and may be powered by battery, direct AC source, or AC adaptor, as the case may be.

When the motor 582 is operated, it rotates the driving cam 580, which in turn contacts and urges the projection 558 of the actuator lever 556, thereby causing the actuator lever 556 to rotate in a counterclockwise direction around the pin 554. With this movement, an arcuate projection 557 located on the actuator lever 556 between the pin 554 and the projection 558 is lifted to actuate a bellows hood 102, which is mounted about the actuating bellows 100 and its bellows ram 101. Actuating the bellows hood 102 compresses the adjuster bellows 100, resulting in compression of the contents of the main enclosure 16 and an attendant increase in the internal pressure which causes the diving objects to dive as described above. As the driving cam 580 continues to turn, the actuator lever 556 rotates in the opposite direction around the pin 554 and moves downward so as to allow the actuating bellows 100 to expand, thereby decompressing the contents of the main enclosure 16 and causing the diving objects to rise via the water conversion principle. The driving cam 580 may be varied to any desired shape so as to modify the frequency and magnitude of the compressing action.

The driving mechanism for the actuating bellows is not limited to that shown in FIG. 10, and the self-adjuster driving mechanism of FIGS. 6 through 8, alternatively may be employed.

In lieu of the automatic self-pressure adjuster 600 shown in FIG. 9, the preferred embodiment of the liquid-filled display or amusement device of FIG. 10 includes a manual pressure adjuster generally indicated by reference numeral 610. The manual pressure adjuster 610 communicates with the main enclosure 16 through a small vent 624 in the main chassis 14*c*. Included in the manual pressure adjuster 610 is a flexible adjuster bellows 612, an adjuster bellows hood 654 disposed about the bottom of the adjuster bellows 614, an adjuster gear 616, a bypass gear 618, a turning gear 620, and a turning wheel or thumbwheel 622. The turning wheel 622 is disposed on an outer bottom corner surface of the bottom cover 14*b*, to afford the user ready access. Mounted coaxially with the turning wheel 622 is the turning gear 620, which engages the bypass gear 618, which in turn engages the adjuster gear 616. The adjuster gear 616 includes a leverage screw thread, so that it moves up and down in the direction shown by arrow G. As the adjuster gear 616 moves up and down, it pushes or pulls the adjuster bellows hood 614 which is attached to the bottom of the adjuster bellows 612. By this arrangement, the volume of the adjuster bellows 612 may be increased or decreased. This allows the user to counterbalance the shrink and expand phenomenon, by adjusting the effective volume, and thus the internal pressure, of the main enclosure 16. In other words, by this arrangement, the initial, baseline internal pressure of the main enclosure may be adjusted. This in turn compresses or decompresses the floating bellows 334 of the diving object 300*f*, which respectively decreases or increases the buoyant force on the diving object.

Although specific embodiments of the present invention have been described above in detail, it will be understood that this description is merely for purposes of illustration. Various modifications of and equivalent structures corresponding to the disclosed aspects of the preferred embodiments in addition to those described above may be made by those skilled in the art without departing from the spirit of the present invention which is defined in the following claims, the scope of which is to be accorded the broadest interpretation so as to encompass such modifications and equivalent structures.

What is claimed is:

1. A display device comprising:

a main enclosure having liquid disposed therein;

a pressure change actuator coupled in fluid communication with said main enclosure for performing at least one of compressing and decompressing of the contents of said main enclosure, thereby respectively increasing and decreasing the internal pressure within said main enclosure; and a diving member disposed in the liquid of said enclosure and having at least one liquid-filled cavity therein in fluid communication with the liquid of said main enclosure, said diving member comprising at least one air-filled flexible member disposed in each said liquid-filled cavity, wherein said diving member has a plurality of said liquid-filled cavities or said diving member has a plurality of said air-filled flexible members disposed in at least one of said liquid-filled cavities.

2. A display device according to claim 1, wherein said air-filled flexible member is compressed and decompressed by the increasing and decreasing, respectively, of the internal pressure within said main enclosure by said pressure change actuator, so as to cause said diving member to fall and rise, respectively, in the liquid of said enclosure.

3. A display device according to claim 1, wherein said air-filled flexible member of said diving member comprises a bellows.

4. A display device according to claim 1, wherein said air-filled flexible member of said diving member comprises a flexible bladder.

5. A display device according to claim 4, wherein said flexible bladder is spherical.

6. A display device according to claim 1, wherein said diving member comprises a rigid shell, in which is disposed said liquid-filled cavity, and wherein said rigid shell has at least one hole communicating the liquid of said main enclosure to and from said liquid-filled cavity.

7. A display device according to claim 6, wherein said air-filled flexible member of said diving member comprises a bellows.

8. A display device according to claim 6, wherein said rigid shell is spherical.

9. A display device according to claim 1, wherein said main enclosure is completely filled with the liquid.

10. A display device according to claim 1, wherein said main enclosure is partially filled with the liquid.

11. A display device according to claim 1, wherein said pressure change actuator comprises a bellows arranged in fluid communication with said main enclosure.

12. A display device according to claim 1, wherein said main enclosure is rigid and transparent.

13. A display apparatus comprising:

a container having liquid disposed therein;

a pressure change actuator for changing the pressure within said container; and an automatic self-pressure stabilizer in fluid communication with the contents of said container which automatically adjusts the pressure within said container in response to shrinkage or expansion of the liquid within said container, said automatic self-pressure stabilizer comprising a valve.

14. An apparatus according to claim 13, further comprising a diving object disposed in the liquid of said container and having a liquid-filled cavity therein in fluid communication with the liquid of said container, said diving object comprising an air-filled flexible member disposed in said liquid-filled cavity, said air-filled flexible member being compressed and decompressed by the increasing and decreasing, respectively, of the internal pressure within said container by said pressure change actuator so as to cause said diving object to fall and rise, respectively, within the liquid.

15. An apparatus according to claim 13, wherein said pressure change actuator comprises (a) a flexible bellows connected to said container and arranged in fluid communication with the contents thereof for compressing the contents of said container, (b) a driving mechanism for driving said flexible bellows to compress said flexible bellows and thus the contents of said container, and (c) a coupling mechanism for coupling said flexible bellows and said driving mechanism in accordance with a free length of said bellows member.

16. A display apparatus comprising:

a container having liquid disposed therein;

a pressure change actuator for changing the pressure within said container; and an automatic self-pressure stabilizer in fluid communication with the contents of said container which automatically adjusts the pressure within said container in response to shrinkage or expansion of the liquid within said container, wherein said container has a vent hole, and wherein said automatic self-pressure stabilizer comprises (a) a first bellows arranged in fluid communication with said container through said vent hole and (b) a free puppet valve disposed in said vent hole for regulating passage of liquid through said vent hole, whereby when the liquid expands because of temperature increase, then the liquid passes through said vent hole and said free puppet valve from said container to said first bellows to expand said first bellows, and whereby when the liquid shrinks because of temperature decrease, then the liquid passes through said vent hole and said free puppet valve from said first bellows to said container, thereby adjusting the pressure within said container.

17. An apparatus according to claim 16, wherein said pressure change actuator comprises a second bellows arranged in fluid communication with the contents of said container, and wherein said first bellows of said automatic self-pressure stabilizer is more flexible and has a larger volume than said second bellows of said pressure change actuator.

* * * * *